United States Patent [19]

Kolpin

[11] 4,024,997

[45] May 24, 1977

[54] GUN CASE INCLUDING MEANS FOR SUSPENDING THE GUN CASE FROM A SUPPORT

[75] Inventor: Ronald N. Kolpin, Berlin, Wis.

[73] Assignee: Kolpin Manufacturing, Inc., Berlin, Wis.

[22] Filed: June 4, 1975

[21] Appl. No.: 583,639

[52] U.S. Cl. ..... 224/2 R; 248/340; 224/45 R

[51] Int. Cl.[2] ..... F41B 13/04

[58] Field of Search ..... 224/2 A, 2 R, 2 B, 2 D, 224/5 Z, 1 B, 3, 26 K, 45 R, 45 T, 45 S, 45 Q, 42.46 B, 42.46 R, 42.45 A, 58, 5 R, 5 Q; 150/52; 248/95, 340, 339; 211/113

[56] References Cited

UNITED STATES PATENTS

| | | | |
|---|---|---|---|
| 1,110,993 | 9/1914 | Sisson | 224/2 B |
| 1,230,043 | 6/1917 | Shelton | 224/2 B |
| 1,527,056 | 2/1925 | Martin | 224/42.46 B |
| 1,815,673 | 7/1931 | Kelley | 224/45 X |
| 1,969,258 | 8/1934 | Cross | 224/1 R |
| 2,049,293 | 7/1936 | Fink | 224/2 B |
| 2,213,472 | 9/1940 | Myres | 224/2 B |
| 2,454,908 | 11/1948 | Buxton | 224/45 R |
| 2,455,296 | 11/1948 | Current | 224/2 A |
| 2,627,887 | 2/1953 | Becker | 224/45 R |
| 3,063,570 | 11/1962 | Kroner | 224/42.46 R |
| 3,081,923 | 3/1963 | Bagby | 224/1 A |
| 3,191,652 | 6/1965 | Benson et al. | 224/2 A |
| 3,239,114 | 3/1966 | Norsworthy | 224/2 A |
| 3,316,951 | 5/1967 | Jacobson | 224/5 R |
| 3,664,560 | 5/1972 | Perkins | 224/5 R |
| 3,762,616 | 10/1973 | Brunstetter | 224/2 B |
| 3,865,166 | 2/1975 | Pedro | 150/52 R |

FOREIGN PATENTS OR APPLICATIONS

| | | | |
|---|---|---|---|
| 18,657 | 8/1907 | United Kingdom | 224/2 A |
| 608 | 1/1901 | United Kingdom | 224/2 A |

*Primary Examiner*—Robert J. Spar
*Assistant Examiner*—Kenneth Noland
*Attorney, Agent, or Firm*—James E. Nilles

[57] ABSTRACT

A gun case including means for suspending the gun case from a support in such a manner that the gun case may be conveniently stored. The gun case includes at least one openable loop securely attached thereto and receivable around a support such as a clothes rod or a hanger to permit the gun case to be suspended from the support. The openable loops supporting the gun case are releasably secured by metal snaps, buckles or Velcro straps. The gun case may be provided with a rigid hanger receiving a pair of spaced openable loops and permitting the gun case to be suspended from the rod of a clothes closet. The gun case may also be provided with means for permitting the gun case to be attached to a belt and thereby form a holster and including a resilient bumper secured to the end of the gun case to protect the muzzle of a gun received in the gun case and zipper-like slidable fastener means which permit access to the gun within the gun case such that the gun therein may be easily removed when the gun case is used as a holster.

15 Claims, 19 Drawing Figures

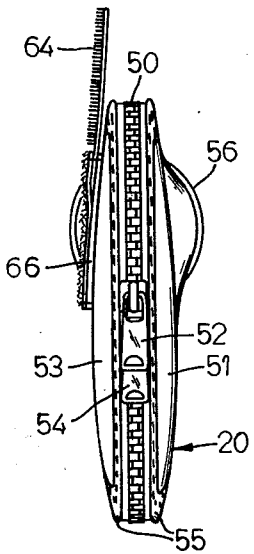
FIG. 9
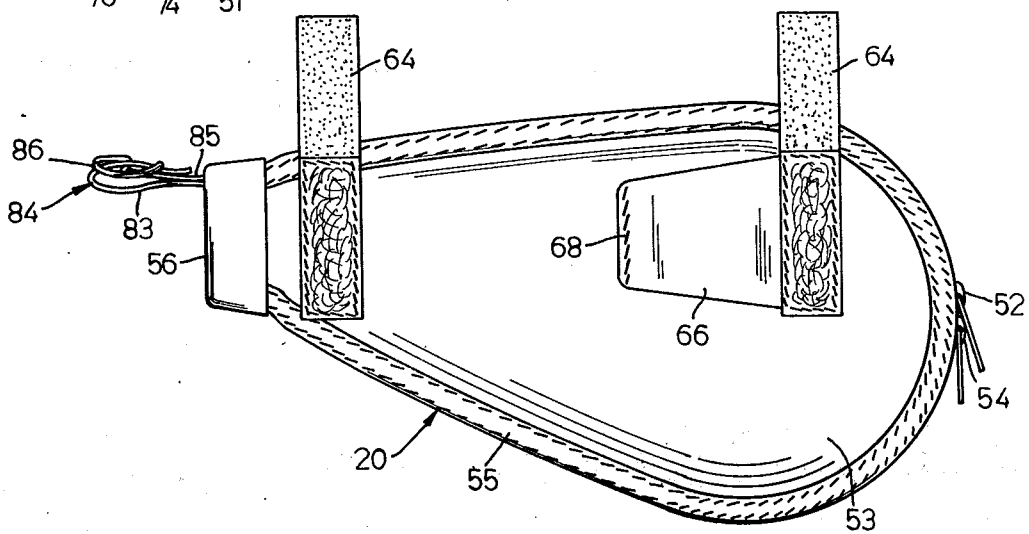
FIG. 7
FIG. 10
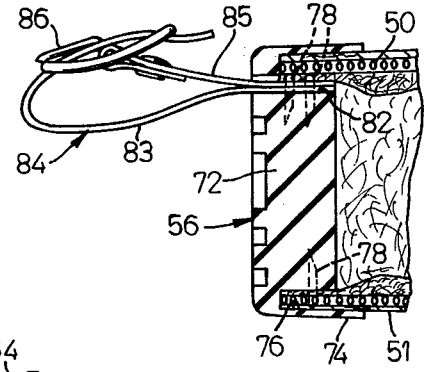
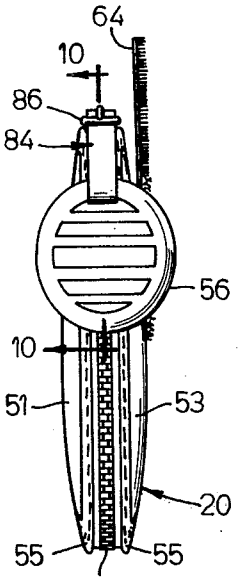
FIG. 8

GUN CASE INCLUDING MEANS FOR SUSPENDING THE GUN CASE FROM A SUPPORT

BACKGROUND OF THE INVENTION

The present invention relates to gun cases including means to facilitate convenient storage of the gun case. More specifically, the invention relates to an improved means for removably suspending a gun case from a support whereby the gun case may be conveniently and safely stored. The invention further relates to an improved handgun case including means to permit convenient storage and means to facilitate the use of the handgun case as a holster.

An example of the prior art gun cases is illustrated by the patent to Koplin, U.S. Pat. No. 2,901,018, issued Aug. 25, 1959, wherein the gun case is shown as including a closed loop attached to one end of the gun case and used to suspend the gun from a hook or similar support means.

SUMMARY OF THE INVENTION

The present invention provides a gun case which includes substantial improvements over such prior art in that it facilitates more convenient storage of the gun case and the gun stored therein by including means to suspend the gun case from a support such as a hanger or a clothes rod.

More specifically, the invention includes openable loops which are secured to the gun case and which can be closed around a support means such as a hanger or clothes rod to permit the gun case to be suspended thereby. The openable loops can include metal snaps, buckles or Velcro straps as the means to secure them in closed relation around the support. One embodiment of the invention includes a gun case having a pair of spaced openable flexible loops and a rigid hanger, the loops being spaced such that they can be secured to opposite ends of a hanger thereby permitting the gun case to be suspeneded by the hanger and in such a manner that the muzzle of a gun received in the gun case points downwardly. A second embodiment of the invention includes a handgun case having a pair of openable loops for receiving the opposed ends of a hanger and further includes means which permit the handgun case to be suspended from a belt so that it can be used as a holster. To further facilitate its use as a holster, the handgun case includes a zipper arranged to permit easy withdrawal of the gun from the gun case and further includes a resilient bumper attached to one end and designed to protect the muzzle of a handgun received in the gun case. A third embodiment of the invention is directed to a handgun case having a flexible openable loop attached to it whereby the handgun case can be directly suspended from a clothes rod. A fourth embodiment of the invention sets forth an elongated gun case for a shotgun or a rifle including a resilient bumper secured to one end thereof and including an openable loop embedded in the bumper and operable to support the gun case in suspended relation from a clothes rod or similar support means.

The use of the openable loops secured to each of the gun cases shown in the embodiments of the invention set out herein permit the gun cases to be suspended from a support and facilitate convenient storage of the gun cases in a closet without the requirement of additional hooks secured to a wall or the like and permits the gun cases to be stored in a closet in back-to-back relationship with garments stored therein and prevents the gun case from taking up unnecessary room in the closet. This means also allows the gun to be concealed by clothes placed on either side of it or hung on the hanger supporting the gun case. The means of storing the gun case as set out in the present invention also permits rifles or shotguns to be stored muzzle downward which in some cases is advantageous in that it prevents oil from draining into the breach of the gun.

Further advantages and objects of the invention will be readily apparent by reference to the following specification and the drawings.

BRIEF DESCRIPTION OF THE DRAWINGS

FIG. 7 is a view similar to that of FIG. 6 but showing the openable loops in an open position and the hanger removed;

FIG. 8 is a left side elevation view of the gun case shown in FIG. 7;

FIG. 9 is a right side elevation view of the gun case shown in FIG. 7;

FIG. 10 is an enlarged partial cross-sectional view taken along line 10—10 in FIG. 8;

DESCRIPTION OF THE PREFERRED EMBODIMENT

Figure 1:
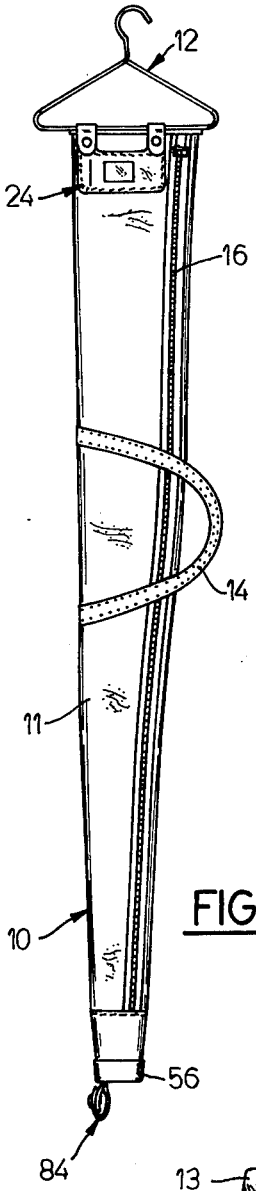
FIG. 1 is a side elevation view of a first embodiment of the present invention.

FIGS. 1—4 illustrate a first embodiment of the present invention showing a gun case 10 suspended vertically from a hanger 12. The gun case shown in FIG. 1 is of the type generally used for shotguns or rifles and includes an elongated hollow case body 11 constructed of a generally flexible material such as leather, canvas, vinyl, cloth or other suitable material. The hollow body 11 may also include a lining material comprising padding to prevent damage to a gun stored in the gun case. The gun case 10 includes a handle 14 to facilitate carrying and a zipper-type slide fastener 16 along the side of the gun case to permit removal or insertion of a gun into the gun case 10. The gun case 10 also includes a bumper 56 secured to the generally tubular end portion of the case generally occupied by the muzzle of a gun placed therein. The bumper 56 is comprised of a generally resilient material, such as rubber, and is included to protect the muzzle of the gun from damage. The bumper 56 also includes an openable flexible loop 84 which is rigidly attached thereto and functions to provide additional alternative means to suspend the gun case 10 from a support as will be described hereafter.

Figure 2:
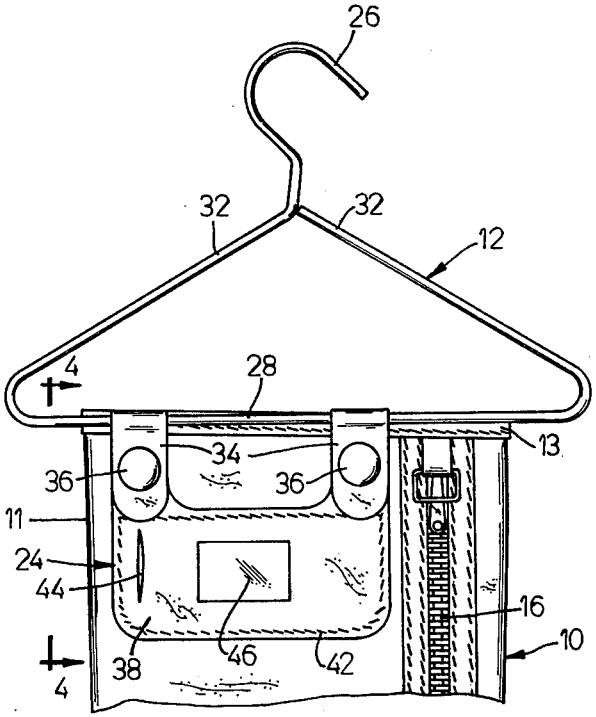
FIG. 2 is an enlarged view of a portion of FIG. 1 showing the hanger and the means for attaching the gun case to the hanger.
Figure 3:
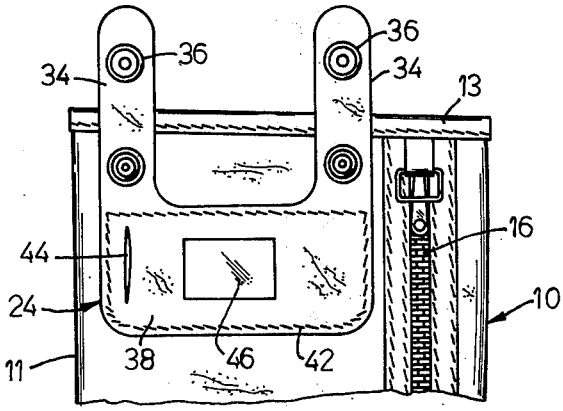
FIG. 3 is a view similar to that shown in FIG. 2 but showing the openable loops in an open position and the hanger removed.

As generally shown in FIG. 1, but more specifically shown in FIGS. 2 and 3, the gun case 10 is suspended from a rigid hanger 12 by an attaching means 24. Referring to FIG. 2, the hanger 12 is shown as including a generally rigid hook 26 integrally attached to a horizontally extending rod 28 supported from the hook 26 by a pair of arms 32. The attaching means 24 for supporting the gun case 10 from the hanger 12 includes a pair of openable loops 34 comprised of a flexible material such as leather or vinyl. The openable loops 34 pass over the rod 28 and can be secured to form a closed loop. The openable loops 34 are shown as including metal snaps 36 which releasably maintain the loops 34 in a closed relationship. Other securing means, such as buckles or Velcro straps could also be used to secure the loops. As best shown in FIG. 3, the loops 34 are integrally attached to a pocket member 38 which is stitched by stitiching 42 to the gun case 10. The pocket 38 includes a slit 44 and a transparent window 46, the slit 44 allowing an identification card or the like to be received therethrough and displayed through the transparent window 46.

FIG. 3 also shows more clearly the configuration of the loops 34 when the snaps 36 have been released and when the gun case 10 has been removed from the hanger 12. As shown in FIG. 3, the loops are integral extensions of the material comprising the pocket 38 and can therefore be inexpensively included during the manufacture of the gun case since no manufacturing steps in addition to those used to stitch the identification card pocket onto the gun case are necessary to secure the loops to the outside of the gun case. As also shown in FIG. 3, the hollow case body 11 is closed along its upper end by the stitched binding 13.

Figure 4:
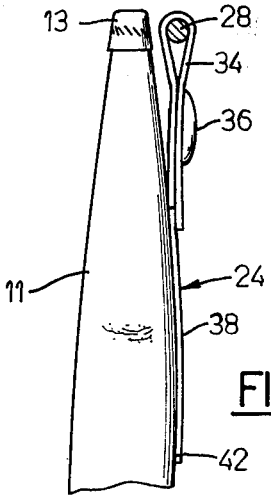
FIG. 4 is a cross-sectional view along line 4—4 in FIG. 2.

FIG. 4 is a cross-sectional view along the line 4—4 shown in FIG. 2 and clearly shows the manner in which the loops 34 are passed around the rod 28 of the hanger 12 and secured by metal snaps 36 such that the gun case can be suspended from the rod 28 of the hanger 12. By providing a pair of spaced loops 34 rather than a single loop the gun case 10 is prevented from swinging on a supporting shaft and is more securely supported.

FIGS. 5–12 show a second embodiment of the present inventin wherein a handgun case 20 is provided with means for being suspended from a hanger 12 in a manner similar to that shown in FIGS. 1–4 for suspending the gun case 10.

Figure 12:
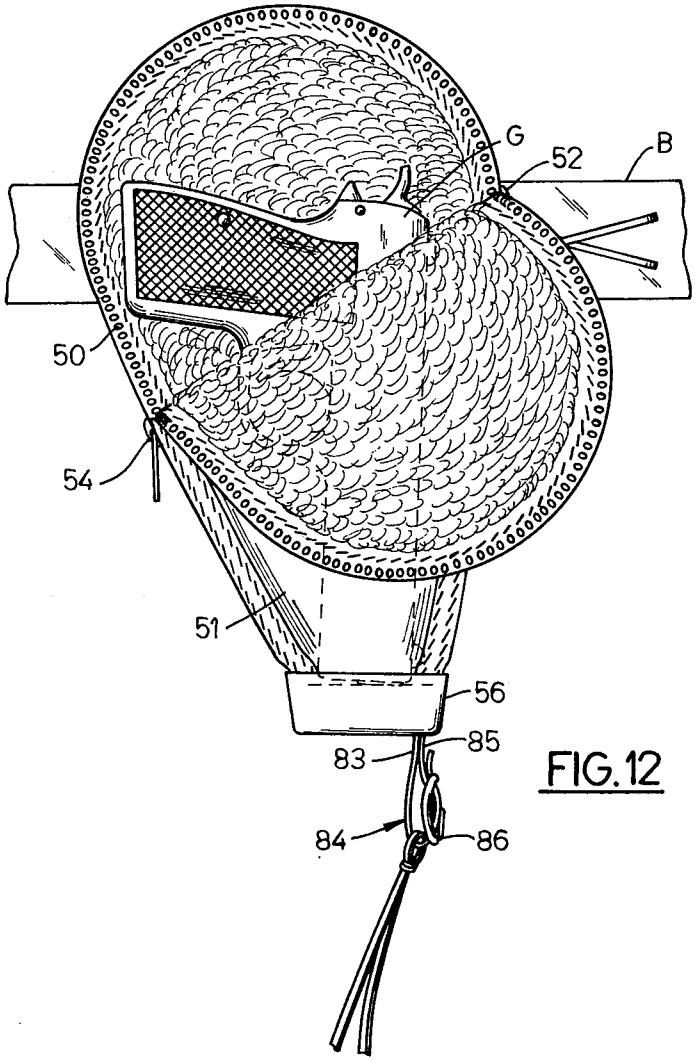
FIGS. 11 and 12 are side elevation views showing the handgun case received on a belt.

The handgun case 20 shown in FIGS. 5–12 is similar to the gun case 10 shown in FIGS. 1–4 in that it may also be constructed of materials such as leather, fabric, canvas, vinyl, expanded vinyl or other suitable materials and defines a generally hollow padded handgun receiving chamber. The handgun case 20 includes a pair of opposed flexible side walls 51 and 53 which are secured together at one end by a resilient bumper 56 and which are releasably joined around the remainder of their peripheral edges by a zipper-like slide fastener 50. The zipper-like slide fastener 50 is secured to each of the flexible side walls 51 and 53 by binding material 55 which is stitched thereto. The flexible resilient bumper 56 which is securely attached to the generally tubular end of the handgun case 20, as will be described infra, is designed to receive the muzzle end of a handgun as shown in FIG. 12 and to cushion the muzzle from any shocks or blows to thereby protect the muzzle and the front sight of the gun. The zipper-like slide fastener 50 includes a pair of zipper actuators 52 and 54 which can operate to form an opening to permit access to the gun case or to completely separate the flexible side walls 51 and 53 to the extent that they are connected only by the resilient bumper 56.

Figure 5:
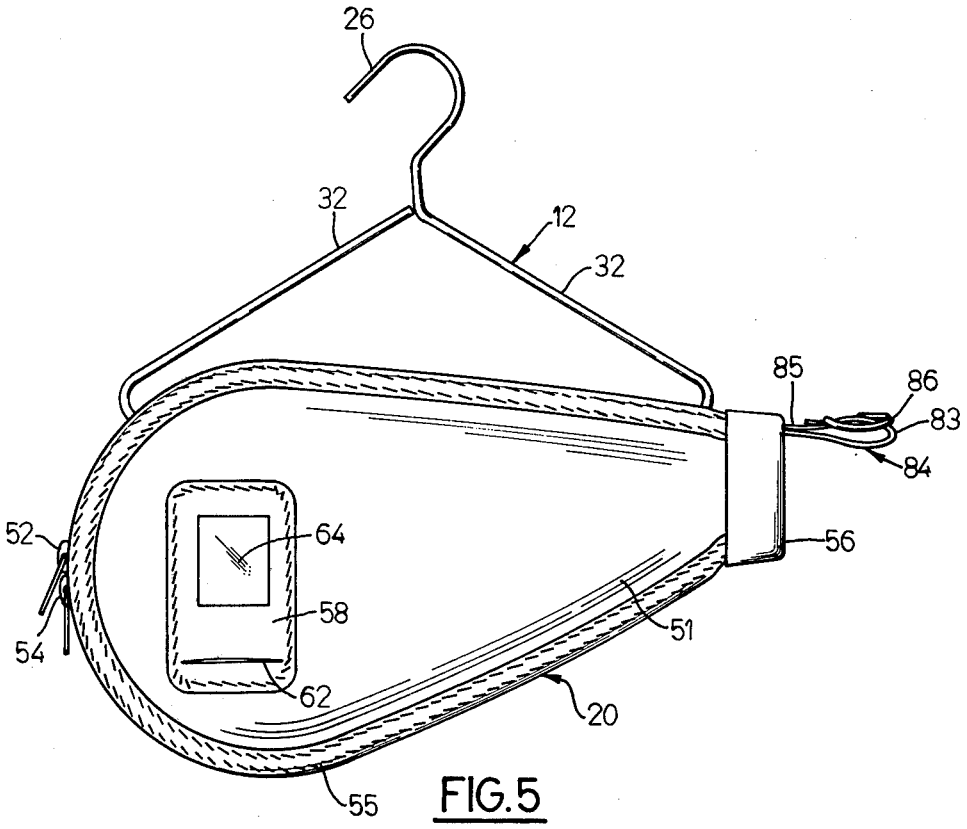
FIG. 5 is a front side elevation view of a second embodiment of the present invention showing a handgun case suppported by a hanger.

Referring to FIG. 5, the side wall 51 includes a pocket member 58 which is stitched to its outer surface and which is designed to receive an identification card therein. The pocket member 58 includes a slot 62 for receiving an identification card and transparent window 64 comprised of a plastic material for displaying said card.

Figure 6:
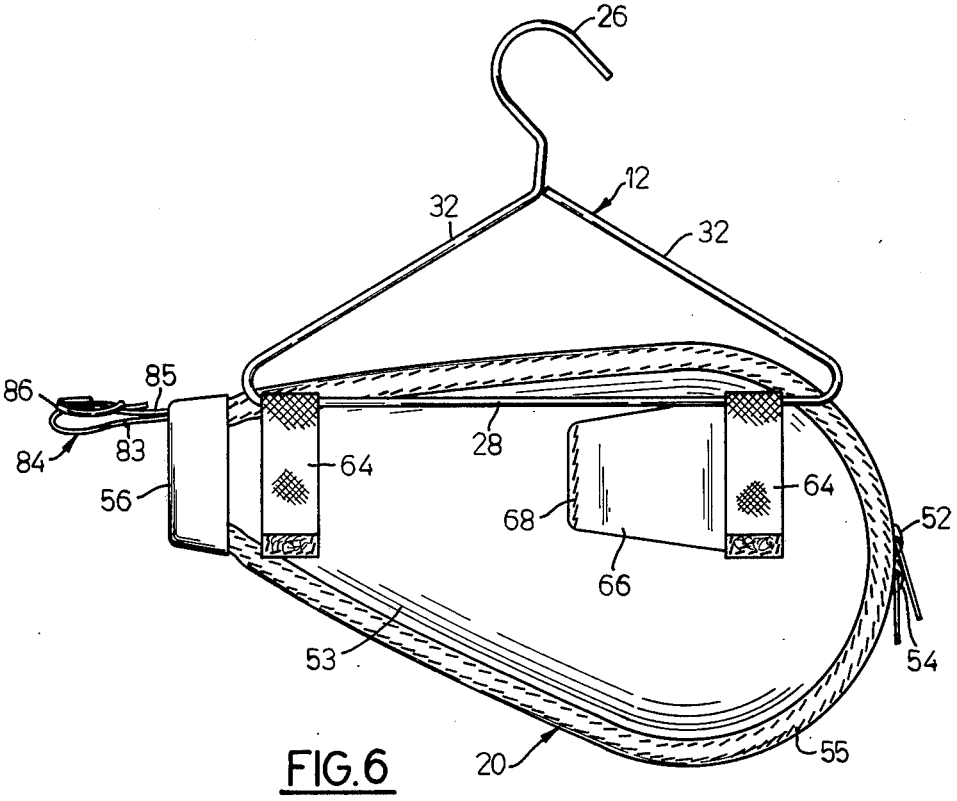
FIG. 6 is a rear side elevation view of the handgun case and hanger shown in FIG. 5.

FIG. 6 shows more clearly the means by which the handgun case 20 is suspended from the hanger 12. A pair of openable loops 64 are stitched to the outside surface of the side wall 53 and are located thereon in spaced relation with respect to each other so as to be received around each end of the rod 28 of the hanger 12. The loops 64 are comprised of Velcro straps such that the ends of the openable loops 64 may be folded around the rod 28 and pressed into engagement with that part of the openable loops which is secured to the side wall 53 to form a binding engagement. The Velcro strap material is sufficiently mutually adhering to allow substantial weight to be placed on the straps, and the openable loops 64 can readily support the weight of the handgun case 20 and a gun contained therein in suspended relation from the rod 28.

Figure 11:
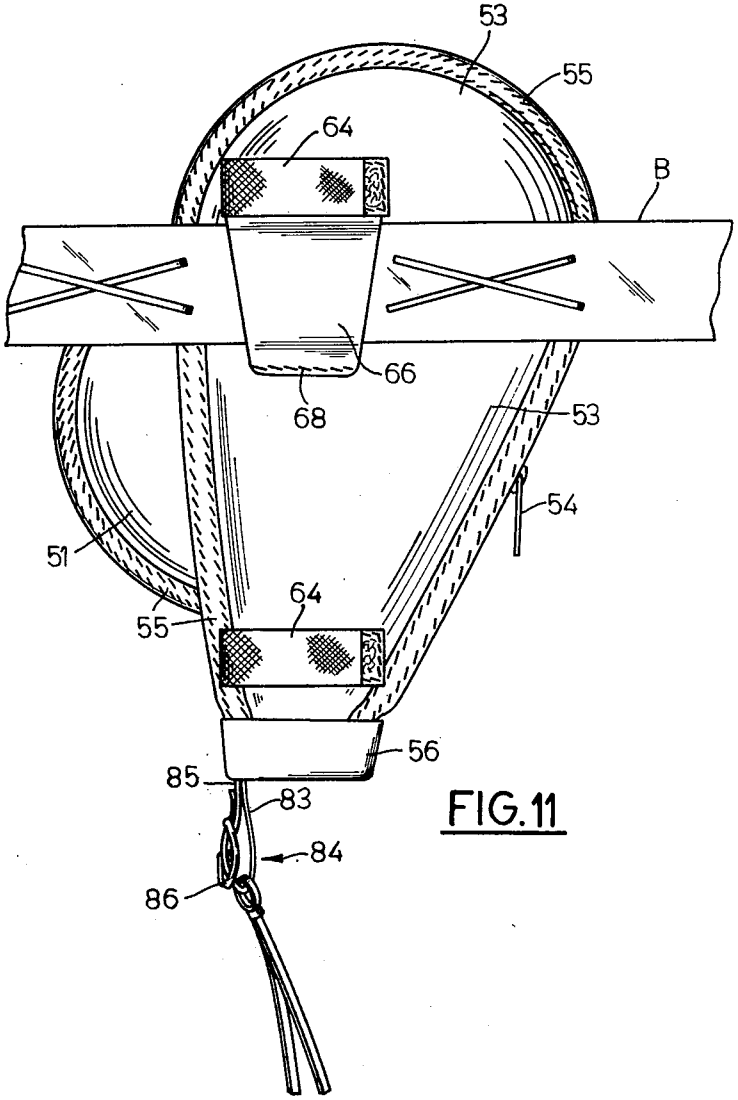

The handgun case 20 shown in FIGS. 5—12 has additional constructional advantages for permitting the handgun case to be used as a holster. As shown for example in FIG. 11, the side wall 53 of the handgun case 20 includes a belt loop 66 which is stitched thereto by stitching 68. The belt loop 66 permits the handgun case 20 to be suspended from a belt B in such a manner that a handgun G held in the handgun case 20 is supported with the muzzle downward. FIGS. 11 and 12 illustrate further that the zipper-like slide fastener 50 and the pair of zipper actuators 52 and 54 have particular utility in permitting the handgun case 20 to be used as a holster since the zipper actuators 52 and 54 and the zipper-like slidable fastener 50 can be opened at any desired position around the periphery of the handgun case to permit access to the gun G held within the handgun case 10.

Figure 16:
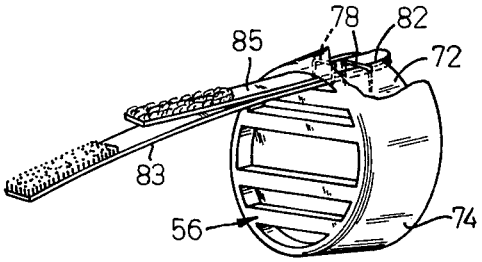
FIGS. 16–18 show three different embodiments of openable loops of the present invention attached to a resilient bumper.
Figure 19:
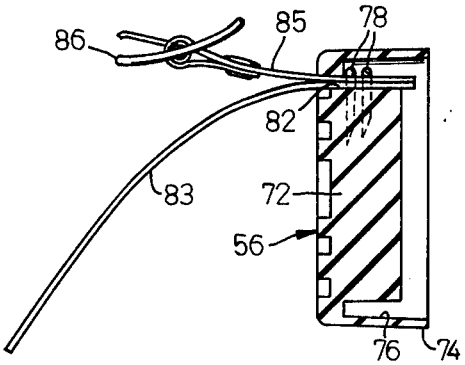
FIG. 19 is a cross-sectional view similar to that of FIG. 10 but showing the openable loop in an open position.

FIG. 10 shows a cross-sectional view of the manner in which the resilient bumper 56 is secured to the end of the handgun case 20 and, particularly, to the side wall 51. The resilient bumper is constructed of a semi-hard rubber and includes a generally oval-shaped inner block of rubber designated by the numeral 72 and a flexible outer annular wall 74. The oval-shaped inner block 72 and the outer annular wall define therebetween an annular groove 76 for receiving the end of the handgun case 20 and, more particularly, the ends of side walls 51 and 53. The annular wall 74 is constructed of a material having sufficient flexibility to permit it to be pulled outwardly away from the oval-shaped inner block 72 to thereby permit staples 78 to be forced through the side walls 51 and 53 into the oval-shaped inner block 72. The resilient bumper 56 also includes a generally rectangular bore 82 extending therethrough and receiving an openable loop 84 therein. As best shown in FIGS. 10, 16 and 19, the openable loop 84 is comprised of a pair of flexible straps 83 and 85 which include means for being releasably joined to form a loop. The ends of the straps 83 and 85 are secured in the bore 82 by additional staples 78 which extend into the oval-shaped block 72. The openable loop 84 may be comprised of materials such as leather, plastic or other similar materials and may include a buckle 86. The buckle 86 permits the loop 84 to be openable such that the loop can be used as an alternate means of supporting the handgun case 20. For example, the handgun case could be supported from a clothes rod or the like by buckling the loop around the clothes rod.

Figure 15:
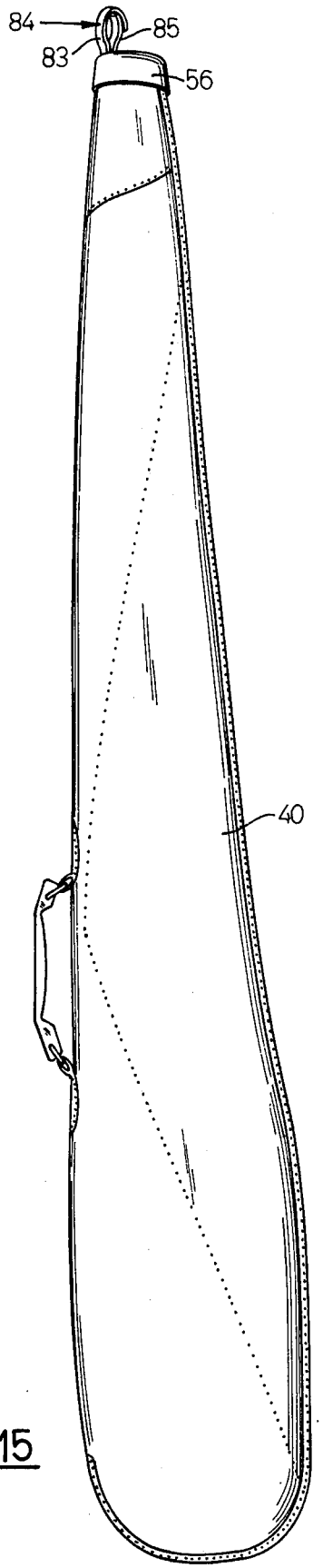
FIG. 15 is a side elevation view showing a fourth embodiment of the invention.

The resilient bumper 56 which includes the openable loop 84 attached thereto can also be used on an elongated gun case as illustrated in FIG. 15 wherein a gun case 40 is shown as including a resilient bumper 56 having an openable loop 84 attached thereto. The resilient bumper 56 is attached to the end of the elongated gun case 40 in the same manner as was described with respect to the attachment of the resilient bumper 56 to the handgun case 20.

Figure 17:
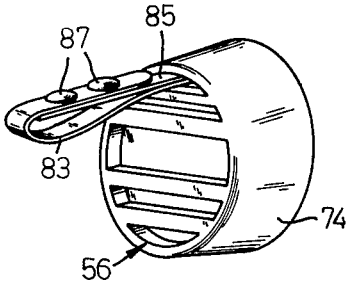
Figure 18:
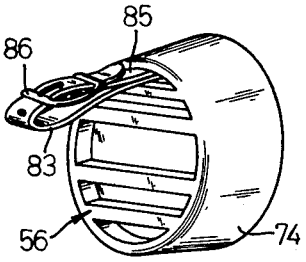

The resilient bumpers shown in FIGS. 15 and 16 show the openable loop 84 as including a pair of flexible straps 83 and 85 which include Velcro material secured to their respective ends in such a manner that the ends of the straps may be pressed together to form a securely closed loop which permits the gun case containing a gun therein to be suspended from a support means such as a clothes rod. The resilient bumpers shown in FIGS. 17 and 18 show, alternatively, the use of metal snaps 87 and a buckle 86, respectively, as means to secure the flexible loop in a closed condition. FIG. 19 is a partial cross-sectional view of the resilient bumper 56 shown in FIG. 18 and further illustrates the means by which the straps 83 and 85 are attached to the resilient bumper 56.

Figure 14:
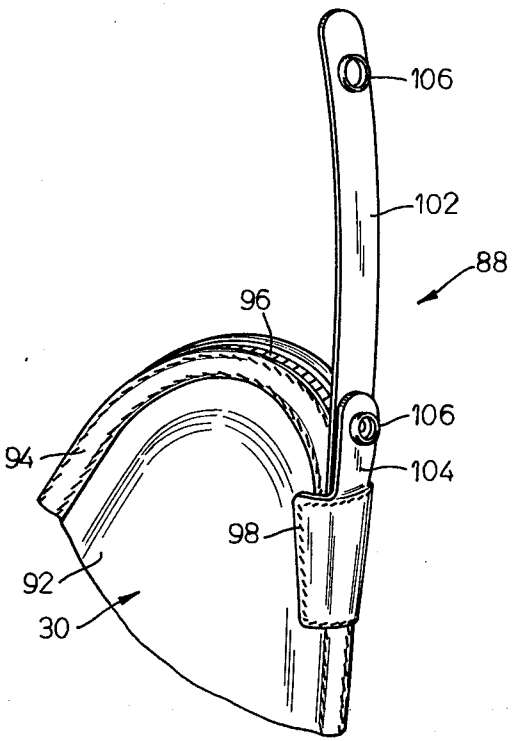
FIG. 14 is an enlarged perspective view of a portion of the handgun case shown in FIG. 13 and showing the openable loop in an open position.
Figure 13:
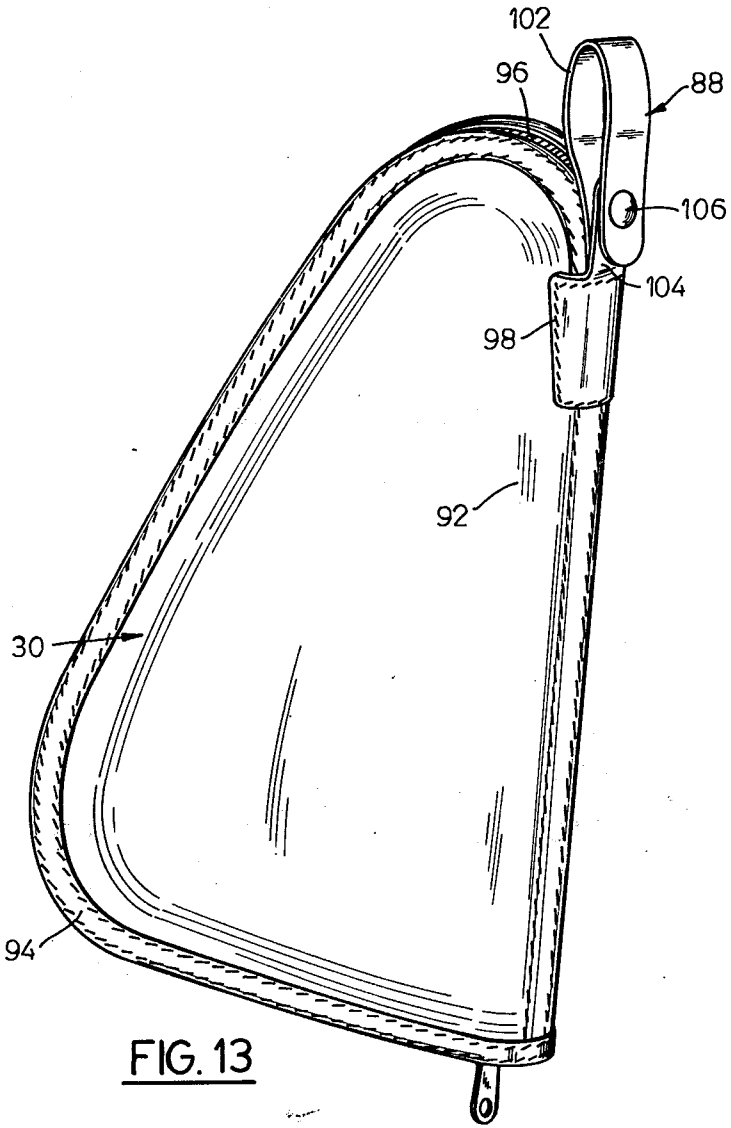
FIG. 13 is a perspective view of a third embodiment of the invention.

FIGS. 13 and 14 illustrate another embodiment of the invention wherein a handgun case 30 is provided with an openable loop 88 secured to one end of the case and adapted to be used to suspend the handgun case 30 from a support means such as a clothes rod. More specifically, the handgun case 30 is comprised of a folded flexible material such as leather, vinyl or other suitable materials to form a generally hollow chamber to receive a handgun therein. The edges of the folded flexible material include a binding 94 stitched thereto and a zipper-like slidable fastener 96.

The openable loop 88 is comprised of a pair of flexible straps 102 and 104 which are secured at one end by stitching 98 to the handgun case 30. As best shown in FIG. 14, each of the flexible straps 102 and 104 includes a metal snap fastening means 106 such that the respective straps can have their ends secured together to form a closed loop as shown in FIG. 3. The openable loop 88 thus permits the handgun case 30 to be suspended from a support means such as a clothes closet rod.

A distinct advantage arises from permitting a suspension of the handgun case 30 from the clothes closet rod in that the handgun case may be suspended between items of clothing hung from the closet rod and concealed thereby. The metal snap fasteners 106 also permit the handgun case to be easily attached or removed from such a support.

RESUME

The present invention thus sets forth improved means for supporting the gun case in such a manner that it can be conveniently and safely stored by providing openable loop means attached to the gun case which allow it to be suspended from a hanger, clothes rod or other similar support. The openable loop means of the invention is particularly advantageous in that it permits the gun case to be suspended from a clothes rod in parallel relation with other garments hung from the clothes rod thereby permitting the gun case to be stored with a maximum of space conservation and in a generally concealed position. The arrangement also secures the gun case and alleviates any danger of the gun being damaged as might be the case if the gun is merely propped against a wall or in a corner.

The invention also sets forth a gun case which includes means to facilitate use of the gun case as a holster, thereby substantially increasing its versatility.

An additional advantage of the present invention is that it provides means to suspend a gun case, and particularly a handgun case, high enough to be out of the reach of children.

I claim:

1. A gun case comprising: a hollow case body having a muzzle end and a butt end for receiving a gun therein, an identification card holder secured to said butt end and a pair of openable loops for removably suspending said gun case from a shaft, said openable loops extending from said card holder and each including a detachable connection for opening and closing said openable loops, whereby said openable loops, when closed, can be removably attached to opposite ends of said shaft and embrace said shaft and, when open, can be removed from said shaft, whereby said gun case may be removably and vertically suspended from said shaft and in generally coplanar relationship with a vertical plane including said shaft.

2. The gun case set forth in claim 1 wherein said openable loops are integrally formed with and extend from said holder.

3. The gun case set forth in claim 2 further including a resilient bumper secured to the muzzle end of said gun case and having an openable loop secured thereto and extending therefrom.

4. The gun case set forth in claim 2 wherein said detachable connection comprises mutually adhesive material secured to said loops.

5. The gun case set forth in claim 1 wherein said detachable connection includes at least one openable snap fastening means.

6. A combination comprising: an elongated gun case having a muzzle receiving end and a butt receiving end, a hanger for suspending said gun case from a support, and loop means for removably attaching said gun case to said hanger and for supporting said gun case with said muzzle receiving end and said butt receiving end in vertically aligned relationship, said hanger including a rigid, open hook for receiving a support therein and a generally horizontally disposed rigid shaft integrally attached to said hook, said loop means including at least a pair of openable loops secured to said butt receiving end in spaced apart relation and each of said openable loops including a detachable connection for opening and closing said openable loops, whereby said openable loops, when closed, can embrace said rigid shaft and, when open, can be removed therefrom, whereby said gun case may be removably suspended from said rigid shaft and in generally coplanar relationship with a vertical plane including said shaft.

7. The combination set forth in claim 6 wherein said detachable connections comprise openable snaps.

8. A combination comprising: a gun case, a hanger for suspending said gun case from a support, and loop means for removably attaching said gun case to said hanger, said hanger including a rigid, open hook for receiving a support therein and a generally horizontally disposed rigid shaft integrally attached to said hook, said loop means including at least a pair of openable loops secured to said gun case in spaced relation and each including a detachable connection for opening and closing said loop means, whereby said loop means, when closed, can embrace said rigid shaft and, when open, can be removed therefrom, whereby said gun case may be removably suspended from said hanger, and an identification card holder secured to an end of said gun case, said openable loop means being integrally formed with said card holder and extending therefrom.

9. A combination comprising: a handgun case, a hanger for suspending said handgun case from a support, and loop means for removably attaching said gun case to said hanger, said hanger including a rigid, open hook for receiving a support therein and a generally horizontally disposed rigid shaft integrally attached to said hook, said loop means including at least a pair of openable loops secured to said gun case in spaced relation and each including a detachable connection for opening and closing said loop means, whereby said loop means, when closed, can embrace said rigid shaft and, when open, can be removed therefrom, whereby said gun case may be removably suspended from said hanger, and wherein said handgun case includes a belt loop secured thereto whereby said handgun case may be suspended from a belt, a pair of slidable zipper actuators for opening said gun case and adapted to permit access to the butt end of a handgun in said case when said case is suspended from a belt, and a resilient bumper member secured to an end of said case and adapted to have the muzzle of said handgun abut against said bumper.

10. A handgun case for receiving a handgun therein, said handgun case comprising: a hollow case body defined by two generally flexible side walls, each having peripheral edges, said peripheral edges joined by slidable fastening means, a belt loop secured to said hollow case body whereby said handgun case may be suspended from a belt, said slidable fastening means including a pair of independently openable closing members for opening and closing said hollow case body and adapted to permit access to a handgun therein when said case is suspended from a belt, a resilient bumper member secured to one end of said case and adapted to have the muzzle of a handgun received in said case abut against said bumper when said case is suspended from said belt, and loop secured to said hollow case body, said loop means including a detachable connection for opening and closing said loop means whereby said loop means, when closed, can embrace a support and, when open, can be removed from said support whereby said gun case may be removably suspended from said support, said support comprising a hanger including a rigid open hook and a generally horizontally disposed rigid shaft integrally attached to said hook and said loop means including a pair of openable loops detachably securable around said shaft.

11. A gun case comprising: a hollow case body having a muzzle end and a butt end for receiving a gun therein, an identification card holder secured to said butt end, and a pair of openable loops for removably attaching said gun case to a hanger including a rigid open hook and a generally horizontally disposed shaft integrally attached to said hook, said pair of loops being spaced apart and extending from said card holder and said pair of loops being detachably securable around opposite ends of said shaft and said loops including a detachable connection for opening and closing said loops, whereby said loops, when closed, can embrace said shaft and, when open, can be removed from said shaft, whereby said gun case may be removably and vertically suspended from said shaft.

12. The gun case set forth in claim 11 wherein said openable loops are integrally formed with and extend from said holder.

13. The gun case set forth in claim 12 further including a resilient bumper secured to the muzzle end of said gun case and having an openable loop secured thereto and extending therefrom.

14. The gun case set forth in claim 12 wherein said detachable connection comprises mutually adhesive material secured to said loops.

15. The gun case set forth in claim 11 wherein said detachable connection includes at least one openable snap fastening means.

* * * * *